US012180968B2

(12) United States Patent
Jensen et al.

(10) Patent No.: US 12,180,968 B2
(45) Date of Patent: Dec. 31, 2024

(54) CENTRIFUGAL PUMP ASSEMBLY

(71) Applicant: GRUNDFOS HOLDING A/S, Bjerringbro (DK)

(72) Inventors: Olav Jensen, Bjerringbro (DK); Bent Døssing, Bjerringbro (DK); Thomas Blad, Bjerringbro (DK); Peter Mønster, Bjerringbro (DK); Ole Hansen, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 4 days.

(21) Appl. No.: 17/921,696

(22) PCT Filed: Apr. 26, 2021

(86) PCT No.: PCT/EP2021/060820
§ 371 (c)(1),
(2) Date: Oct. 27, 2022

(87) PCT Pub. No.: WO2021/219540
PCT Pub. Date: Nov. 4, 2021

(65) Prior Publication Data

US 2023/0167826 A1 Jun. 1, 2023

(30) Foreign Application Priority Data

Apr. 28, 2020 (EP) ..... 20171759

(51) Int. Cl.
*F04D 15/00* (2006.01)
*F04D 1/00* (2006.01)
(Continued)

(52) U.S. Cl.
CPC ..... *F04D 15/0016* (2013.01); *F04D 1/006* (2013.01); *F04D 13/06* (2013.01);
(Continued)

(58) Field of Classification Search
CPC ..... F04D 15/0016; F04D 1/006; F04D 13/06; F04D 29/4293; F04D 29/486; F24D 3/08; F24D 3/105
See application file for complete search history.

(56) References Cited

U.S. PATENT DOCUMENTS 5,924,432 A 7/1999 Thies et al.
2020/0116161 A1 4/2020 Blad et al.

FOREIGN PATENT DOCUMENTS

EP 3376049 A1 * 9/2018 ..... F04D 1/006
EP 3540234 A1 9/2019

OTHER PUBLICATIONS

Machine Translation of EP3376049A1 PDF File Name: "EP3376049A1_Machine_Translation.pdf".*

* cited by examiner

*Primary Examiner* — Grant Moubry
*Assistant Examiner* — Ruben Picon-Feliciano
(74) *Attorney, Agent, or Firm* — McGlew and Tuttle, P.C.

(57) ABSTRACT

The invention relates to a centrifugal pump assembly having an electric drive motor (2), at least one impeller (14) driven by said electric drive motor (2) and a valve element (24; 24') rotatable between two 5 valve positions driven by a fluid flow produced by said impeller (14), wherein the valve element (24; 24') has a cover plate (104; 104') extending transverse to the rotational axis (X) of the impeller (14) and facing the impeller (14), wherein the valve element (24; 24') having protrusions (102, 102') arranged on an outer surface side facing away 10 from the impeller (14) such that a flow can act on them for driving the valve element (24; 24').

20 Claims, 15 Drawing Sheets

(51) Int. Cl.

| | |
|---|---|
| ***F04D 13/06*** | (2006.01) |
| ***F04D 29/42*** | (2006.01) |
| ***F04D 29/48*** | (2006.01) |
| ***F24D 3/08*** | (2006.01) |
| ***F24D 3/10*** | (2006.01) |

(52) U.S. Cl.
CPC ..... *F04D 29/4293* (2013.01); *F04D 29/486* (2013.01); *F24D 3/08* (2013.01); *F24D 3/105* (2013.01)

CENTRIFUGAL PUMP ASSEMBLY

CROSS REFERENCE TO RELATED APPLICATIONS

This application is a United States National Phase Application of International Application PCT/EP2021/060820, filed Apr. 26, 2021, and European Patent EP 20171759.2, filed Apr. 28, 2020, the entire contents of which are incorporated herein by reference.

TECHNICAL FIELD

The invention refers to a centrifugal pump assembly comprising a pump device driven by an electric drive motor and a valve element.

BACKGROUND

In particular in smaller buildings compact heating systems are used for heating the building and providing domestic hot water. Those systems commonly comprise a hydraulic valve device for switching the flow of heating medium between a heating circuit in the building and a heat exchanger for heating the domestic water.

From EP 3 376 049 it is known to integrate such a valve device into the circulator pump device such that the valve element of the valve device is shifted between two possible valve or switching positions by use of the water flow produced by the pump.

SUMMARY

It is the object of the invention to further improve such a centrifugal pump assembly comprising a valve element driven by the fluid flow such that a more reliable switching of the valve between the two possible switching or valve positions can be achieved.

This object is achieved by a centrifugal pump assembly comprising the features defined in claim 1. Preferred embodiments are disclosed in the dependent subclaims, the following description as well as the accompanying drawings.

The centrifugal pump assembly according to the invention comprises an electric drive motor and at least on impeller driven by said electric drive motor. The electric drive motor may have a rotor, preferably a permanent magnetic rotor connected to the impeller via a rotor shaft. The electric drive motor in particular may be a wet running electric drive motor with a rotor can between the rotor space and the stator space containing the stator windings of the drive motor. In this design the rotor space is filled by the liquid to be pumped, in particular water. The impeller is rotating inside a pump housing having at least one inlet and one outlet port. The centrifugal pump assembly further comprises a valve device integrated into the centrifugal pump assembly. The valve device comprises a valve element which is rotatable between two possible valve or switching positions. The valve element is moved between these valve positions by a fluid flow produced by said impeller, in particular a fluid flow flowing in circumferential direction around the impeller. The valve element may be designed to selectively open two inlet ports or to selectively open two outlet ports of the centrifugal pump assembly. Thereby, the valve element may change the fluid flow for example between a heating circuit for heating a building and a heat exchanger for heating domestic water.

The valve element comprises a cover plate extending transversely to the rotational axis of the impeller and facing the impeller. Preferably, this cover plate extends parallel to the face side of the impeller, in particular a face side of the impeller comprising a suction port in its center. The cover plate of the valve element preferably forms one of the walls delimiting a pump space inside which the impeller is arranged. The cover plate preferably is in contact with the fluid flow on the outside of the impeller, in particular of a fluid flow in rotational direction inside the pump space.

According to the invention the valve element comprises protrusions arranged on an outer surface side facing away from the impeller such that a flow can act on them for driving the valve element. The fluid flow produced by the impeller may act on these protrusions so that the protrusions constitute force application surfaces onto which a force provided by the flow or fluid is applied such that it produces a torque acting on the valve element and rotating the valve element around its rotational axis. Since the protrusions are arranged on a surface of the valve element facing away from the impeller, a disturbance of the fluid flow in the direct surrounding area of the impeller is reduced. Thereby a high efficiency of the centrifugal pump can be maintained. The hydraulic resistance produced by the valve element is minimized.

Preferably, the protrusions are provided on the outer circumference of the valve element, i. e. on an outer surface side of the valve element forming the outer circumference of the valve element. Alternatively, the protrusions may be arranged on a back side facing away from the impeller. Thus, the protrusions are preferably not arranged on a surface facing towards the impeller such that they are not arranged inside the fluid flow in the direct surroundings of the impeller. Thereby, the hydraulic resistance is minimized.

According to a further preferred embodiment the protrusions are extending in radial direction related to the rotational axis of the valve element. For example, the protrusions may extend in radial direction from an outer circumferential surface of the valve element. Thus, the protrusions may form a tooth-like structure on the outer circumference of the valve element substantially like a toothed wheel. The gap between the outer circumference of the valve element and a surrounding wall of the housing may be open towards the space containing the impeller such that a fluid flow produced by the impeller may directly impinge on the protrusions arranged on the outer circumference of the valve element. According to a further possible design the protrusion may be inclined in the circumferential direction. The protrusions may form inclined vanes so that a fluid flow flowing in parallel to the rotational axis of the valve element impinges on the inclined surface of the protrusion such that a force in circumferential direction, i.e. a torque acting on the valve element is produced. The protrusions inclined in circumferential direction are inclined with respect to the rotational axis, i.e. an angle between an axis parallel to the rotational axis of the valve element and the surface of the protrusion is between 0° and 90°, preferably between 0° and 60°. The protrusions may extend straight or curved to optimize the fluid flow and the torque acting on the valve element.

Further preferably, in the radial direction the cover plate extends beyond the protrusions, i.e. the cover plate preferably has a diameter greater than the diameter of a circle along the radial outer ends of the protrusions. This means the cover plate covers the protrusions on a side facing towards the impeller. The cover plate, therefore, extends between the impeller and the protrusions. Thus, the fluid flow acting onto the protrusions has to flow around the cover plate or through a gap surrounding the cover plate. Such a flow in particular may be a side flow produced by the impeller, not the main flow leaving the impeller towards an exit port of the pump assembly. In particular the side flow may be a side flow appearing only during an operational condition for movement of the valve element and not during the normal operation of the centrifugal pump. By this, the flow resistance during normal operation can be further reduced.

According to a further possible embodiment of the invention the rotational axis of the valve element extends parallel to the rotational axis of the impeller and further preferably along the rotational axis of the impeller. This allows a compact arrangement of the impeller and the valve element in one housing. Furthermore, the flow, in circumferential direction, produced by the impeller also flows circularly around the rotational axis of the valve element, thus allowing an optimized hydraulic force or torque transfer between the impeller and the valve element by this fluid flow produced by the impeller.

According to a further embodiment the valve element is arranged inside a housing having a circular inner wall surrounding the outer circumference of the valve element with a ring-shaped gap between the outer circumference of its cover plate and this inner wall. A fluid flow produced by the impeller may enter this gap such that it can act on the protrusions of the valve element, which are arranged on the outlet side of this gap, i. e. on a side of the cover plate facing away from said impeller. According to a further preferred embodiment the cover plate, the valve element and the surrounding wall may be designed such that the gap is substantially closed during normal operation or such that a fluid flow through this gap in another way is inhibited during this normal operation to reduce the hydraulic resistance during normal operation. This may be achieved for example by a linear movement of the valve element closing the gap and/or interrupting the flow path for fluid side flow through the gap into the region in which the protrusions are arranged.

Preferably said protrusions are evenly distributed over the outer circumference of the valve element. By this design an even force or torque transfer onto the valve element can be achieved.

According to a preferred embodiment the protrusions are of tooth-like shape and preferably are extending normally to a cylindrical outer circumferential wall of the valve element, i.e. substantially radially to the centre of the valve element. The valve element, thus, at least partly has the shape of a toothed wheel. The protrusions provide force application surfaces extending in radial direction so that a fluid flow in circumferential direction impinges on these surfaces to create a torque acting on the valve element for rotation of the valve element between the possible valve positions.

According to a further preferred embodiment the protrusions are integrally formed with an outer circumferential wall and/or the cover plate of the valve element. For example the valve element may at least partly be made from plastic material, for example by injection molding. The protrusions are preferably formed in such a part of the valve element formed from a plastic material. This allows an economic production of the valve element comprising the protrusions.

The cover plate of the valve element preferably comprises a central outlet opening being in engagement with a suction mouth of the impeller. The valve element in particular may be a valve element switching the flow on the suction side of the impeller between two possible flow paths, i. e. between two different suction ports. For example one suction port may be connected to a heating circuit of a building and the other suction port may be in connection with a heat exchanger for heating domestic hot water. By changing the valve or switching position one of the flow paths may be closed and the other flow path opened. Preferably the flow paths are both ending in the central outlet opening forming a connection to the suction mouth of the impeller so that a fluid flow between a suction port of the centrifugal pump assembly and the suction mouth of the impeller can be established through the valve element.

According to a further preferred embodiment of the invention said valve element is supported on a central bearing post or pivot and fixed in axial direction on this bearing post by an O-ring, wherein the O-ring preferably engages into a notch on the outer circumference of the bearing post. This embodiment may be realized independently from the arrangement of the protrusions as discussed before, i. e. can be realized also with a valve element not having such protrusions as dis-cussed above. The O-ring has the function of a retaining ring or spring lock washer, respectively. However, the arrangement of the O-ring has at least two advantages. The O-ring has a damping function in axial direction if the valve element abuts against this O-ring. Furthermore, the O-ring can easily be mounted without special tools which allows an easy service in the field. The O-ring forms an axial stop or abutment for the valve element, in particular if the valve element is movable in axial direction as discussed below. The bearing post for example is provided with a circumferential notch or groove on the outer circumference close to its free end. Into this notch the O-ring is inserted such that it protrudes in radial direction. The protruding part of the O-ring, then, forms the abutment.

The bearing post, preferably is attached to an internal surface of a pump housing and preferably integrally formed with at least this internal surface of the pump housing. The pump housing for example may be made from plastic material or metal. This allows to integrally form the bearing post together with the pump housing. In an alternative embodiment the bearing post may be inserted into a receptacle formed in the inner surface of the pump housing, for example in form of a hole or threaded hole. In such an embodiment the bearing post may be pressed or screwed into the hole in the bottom surface of the pump housing. The valve element, preferably is mounted slidable on the bearing post such that a plane bearing is formed between the outer circumference of the bearing post and an inner circumference of a bearing hole inside the valve element.

According to a further special embodiment of the invention the valve element comprises at least one sealing portion for selectively closing a first and a second inlet port such that in a first valve position the first inlet port is closed and in a second valve position the second inlet port is closed. In a special embodiment it may be possible that there are provided two sealing portions, one for the first inlet port and one for the second inlet port, so that in a first valve position the first sealing portion closes the first inlet port and in a second valve position a second sealing portion closes the second inlet port, whereas the other inlet port is opened. Preferably, the valve element allows to change the flow path between the two inlet ports to selectively open one of the flow paths towards the entrance side of the impeller. For example the valve element may be used to switch between a heating circuit and a heat exchanger for heating domestic water in a heating system.

According to a further preferred embodiment the valve element additionally is movable in linear direction along its rotational axis. This allows the valve element to carry out a further switching movement or action, respectively. In particular by this linear movement a switchable coupling or clutch can be realized. For example, in a first axial position the clutch can be engaged such that the valve element is fixed in its rotational direction. In a second axial position the valve element may be released such that it is movable in rotational direction to be moved between the two possible valve positions. Preferably, the valve element is movable in linear direction such that in the first axial position the at least one sealing portion is in sealing contact with an opposed valve seat and in the second axial position the sealing portion is distanced from the opposed valve seat. Thus, in the first axial position by the engagement with the sealing and possibly with a further engagement surface the valve element is fixed in its rotational direction so that it cannot be moved in rotational direction between the valve positions. Furthermore, a secure sealing is ensured. In the second axial position the valve element is released from the valve seat such that an engagement with the valve seat and possibly a further engagement surface is released and, preferably, the valve element is freely rotatable about its rotational axis to be moved between the valve positions by the flow produced by the impeller. By this axial movement independent from the rotational movement between the valve positions the sealing engagement and the change of the valve positions are decoupled having the advantage that for movement between the valve positions no friction forces occurring from the sealing engagement of the sealing portions have to be overcome. By this the necessary torque or forces for movement of the valve element between the valve positions are reduced.

According to a further embodiment the valve element comprises at least one inlet opening being in flow connection with an outlet opening of the valve element and arranged such that in the first valve position the inlet opening is facing a second inlet port and in the second valve position is facing a first inlet port. This means in a first valve position the inlet opening is opened towards the second inlet port and in a second valve position is opened to the first inlet port so that in the first valve position a fluid flow from the second inlet port through the valve element towards the impeller is established. In the second valve position a respective flow from the first inlet port towards the inlet side of the impeller is established. This by rotational movement of the valve element allows to change the flow path between the two inlet ports to selectively suck liquid or water out of one of the two inlet ports.

In a further embodiment the valve element may comprise a sealing member surrounding the inlet opening and arranged such that in a first axial position of the valve element the sealing member is in contact with an opposing sealing surface or valve seat and in a second axial position of the valve element the sealing member is distanced from this sealing surface or valve seat respectively. Furthermore, preferably said sealing member surrounding the inlet opening of the valve element is arranged on the outer circumference of the valve element. The sealing member provides a closed flow path from one of the inlet ports through the inlet opening and the valve element towards the impeller. Furthermore, preferably the sealing element closes a flow path around the valve element during normal operation of the pump. This may be a flow path for a side flow through the gap between the outer circumference of the valve element, in particular its cover plate, and a surrounding wall of the pump housing. If the valve element is in its axial position distanced from the sealing surface there may occur a side flow from the impeller through the gap surrounding the valve element towards the inlet opening of the valve element. Due to the rotational movement of the impeller this side flow has a spin around the rotational axis of the valve element acting on the protrusions to produce a torque acting on the valve element for its rotational movement. By changing the rotational direction of the impeller, for example by a respective motor control of the drive motor, the direction of the spin can be changed and thus the valve element can be moved into opposite rotational directions to move the valve element between two possible valve positions. In particular by pressure increase produced by the impeller the valve element can be moved in axial direction along the rotational axis such that the sealing members come into contact with an opposing sealing surface and interrupting the side flow acting on the protrusions so that the torque acting on the valve element is reduced. Furthermore, by contact between the sealing member and the sealing surfaces a frictional engagement can be achieved holding the valve element in the respective valve position, preferably even if the rotational direction of the impeller is changed again. If the sealing member surrounding the inlet opening is arranged on the outer circumference of the valve element a great radial distance between the region of frictional engagement and the rotational axis of the valve element can be achieved resulting in a greater holding torque for fixing the valve element in its valve position.

Further preferably, the sealing member surrounding the inlet opening may be arranged on an axial end of the valve element 5 opposite to the axial end formed by the cover plate. Thus, a pressure acting on the cover plate may move the valve element in its axial direction such that the sealing member is pressed again a sealing surface, preferably a sealing surface provided on the bottom side of the pump housing. By this, a frictional engagement can be achieved to hold the valve element in its respective valve position described before.

DESCRIPTION OF PREFERRED EMBODIMENTS

Figure 1:
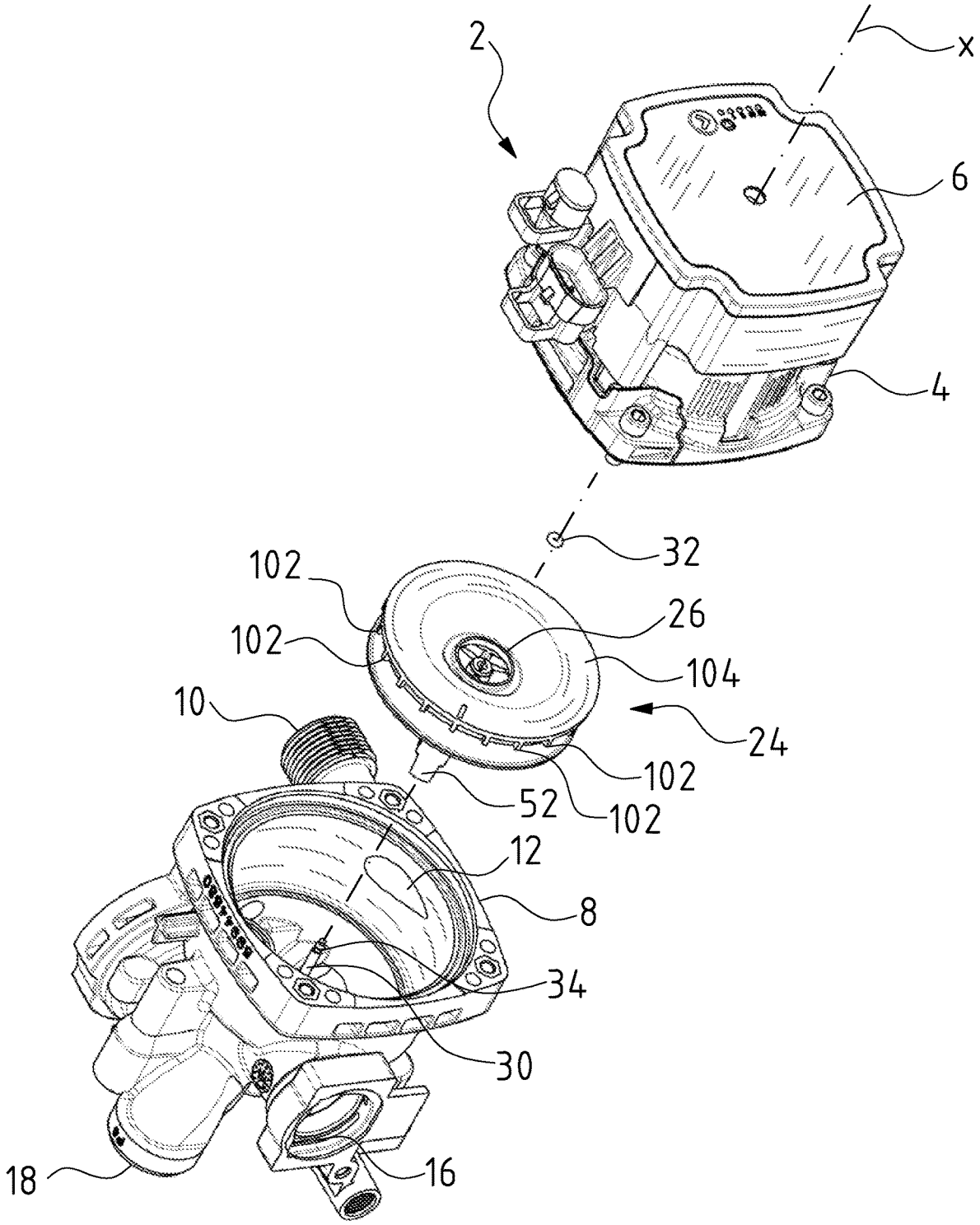
FIG. 1 is an exploded view of a centrifugal pump device according to the invention.
Figure 2:
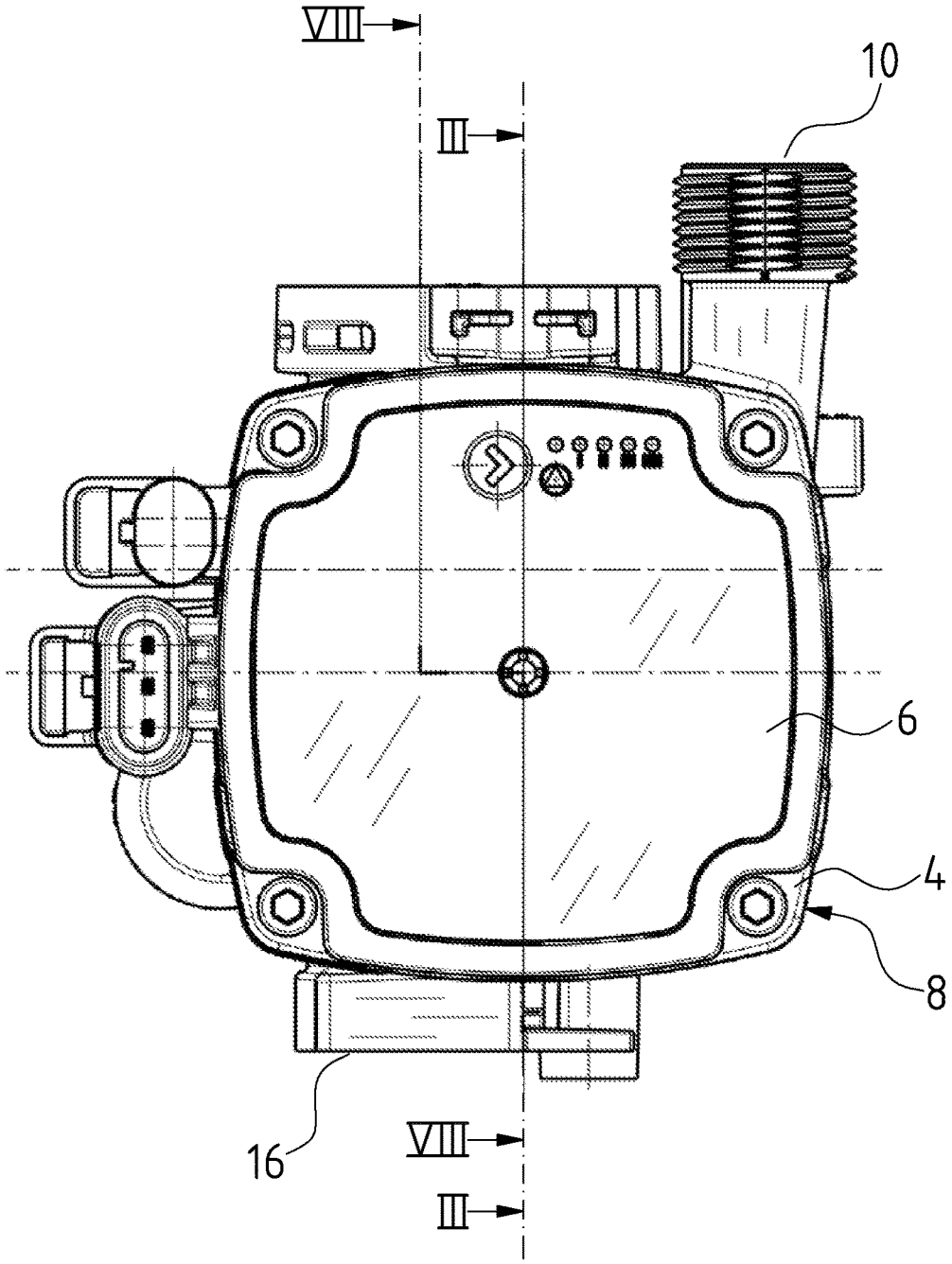
FIG. 2 is a top view on the centrifugal pump device ac-cording to FIG. 1, on the axial end side of the electronic housing.

The centrifugal pump described as an example is a centrifugal pump provided for a heating system. This centrifugal pump device includes a hydraulic valve device which can be used in the heating system to change the fluid flow between a heating circuit through a building and a heat exchanger for heating domestic water.

The centrifugal pump device has an electric drive motor 2 comprising a motor housing 4 inside which the stator and the rotor are arranged. On one axial end of the motor housing, in direction of the longitudinal axis X, there is arranged an electronics housing 6 comprising the control electronics 7 for the electric drive motor. On the opposite axial end the motor housing 4 is connected to a pump housing 8 comprising an outlet connection 10 connected to an outlet port 12 in the inside of the pump housing 8. The outlet port 12 is arranged on the outer circumference of a pump space inside which the impeller 14 is arranged. The pump housing 8, further, comprises two inlet connections 16 and 18. The first inlet connection is provided for a connection to a heating circuit in a building, whereas the second inlet connection 18 is provided for connection to a heat exchanger for warming domestic hot water. The first inlet connection 16 is in fluid connection with the first inlet port 20 inside the pump housing 8. The second inlet connection 16 is in connection with a second inlet port 22 inside the pump housing 8. The inlet ports 20 and 22 are arranged in one flat plane perpendicular to the longitudinal or rotational axis X. The rotational axis X is the rotational axis of the impeller 14 and the valve element 24 described in more detail later. The first and the second inlet ports are arranged in the bottom of the pump housing 8 seen in the longitudinal direction X.

The valve element 24 is arranged to switch over the flow path towards the impeller 14 between the two inlet connections 16 and 18. Basically, the function of this hydraulic valve device is similar as disclosed in EP 3 376 049. The valve element 24 has a central outlet opening 26 facing the suction mouth 28 of the impeller 14 or being in engagement with the suction mouth 28 such that fluid flows from the outlet opening 26 into the suction mouth 28.

The valve element 24 is rotatable about the rotational axis X which corresponds to the rotational axis X of the impeller 14. The valve element 24 is arranged on a pivot or bearing post 30 fixed in the bottom of the pump housing 8. In this embodiment the pivot is molded into the material of the pump housing 8, for example in an injection molding process. However, the bearing post may be fixed in the bottom of the pump housing 8 in different manner, for example being screwed into a threaded hole or being formed integrally with the pump housing 8. The bearing post 30 extends from the bottom of the pump housing 8 in the longitudinal direction X into the interior of the pump housing 8. The valve element 24 is rotatable about the longitudinal axis X and movable in a linear direction on the bearing post 30 along the longitudinal axis X in a certain distance. This certain distance is limited by an O-ring 32 forming an axial stop or abutment for the valve element 24. The O-ring 32 engages into a circumferential groove or notch 34 arranged close to the free distal end of the bearing post 30. The O-ring 32 forms an elastic axial stop and allows an easy assembling without special tools.

In this embodiment the valve element 24 is composed of two parts, a support member 36 and a cover member 38 which are connected by a snap fit. On the inner surface of the cover member 38 there are arranged engagement hooks 40 which embrace or engage with engagement shoulders or projections 42 in the interior of the support member 36. The cover member 38 has a cover plate 104, i.e. a cover of plate like shape, and is completely closed except the central outlet opening 36. When arranged inside the pump housing 8 the cover plate 104 of the cover member 38 forms one axial wall of the pump space 44 inside which the impeller 14 is rotating. The opposite axial wall of the pump space 44 is formed by a bearing plate 46 holding one bearing for the rotor shaft 50. Opposite to the cover member 38 there is connected a spring support 52 to the support member 36. Between the spring support 52 and the support member 36 there is arranged a helical compression spring 54. The spring 54 with one axial end abuts against an interior bottom surface of the spring support 52 and with the opposite axial end abuts against apportion of the support member 36. The spring support 52 overlaps with elastic engagement hooks 56 such that the engagement hooks 56 engage with openings or cut-outs 58 in the outer circumference of the spring support 52 from the inside of the spring support 2. Thereby the spring support 52 is guided on the outside of the legs of the engagement hooks 56 in axial direction X such that the spring support 52 is movable in this axial direction on the outside of the legs of the engagement hooks 56. Furthermore, on the support member 38 there is provided a rib 60 in the spring support 52. Rib 60 and slot 62 allow a relative movement in axial direction, but ensure a torque transfer so that the spring support 52 is connected to the support member 36 substantially torque proof except a limited play in circumferential direction between the rib 60 and the slot 62. This play ensures a damping effect provided by torsion of the compression spring 54 since the spring 54 is in the flux in rotational direction until the rib 60 abuts on one of the edges of the slot 62.

On the axial end opposite to the support member 36 the spring support 52 comprises a bearing portion 64 movably supported on the bearing post 30, i.e. sliding on the outer circumference of the bearing post 30. A further bearing portion 66 in bearing contact with the bearing post 30 is formed in the support member 36. The bearing portion 66 comprises a shoulder protruding in radial direction. Against this shoulder the axial end of the compression spring 54 abuts.

Figure 3:
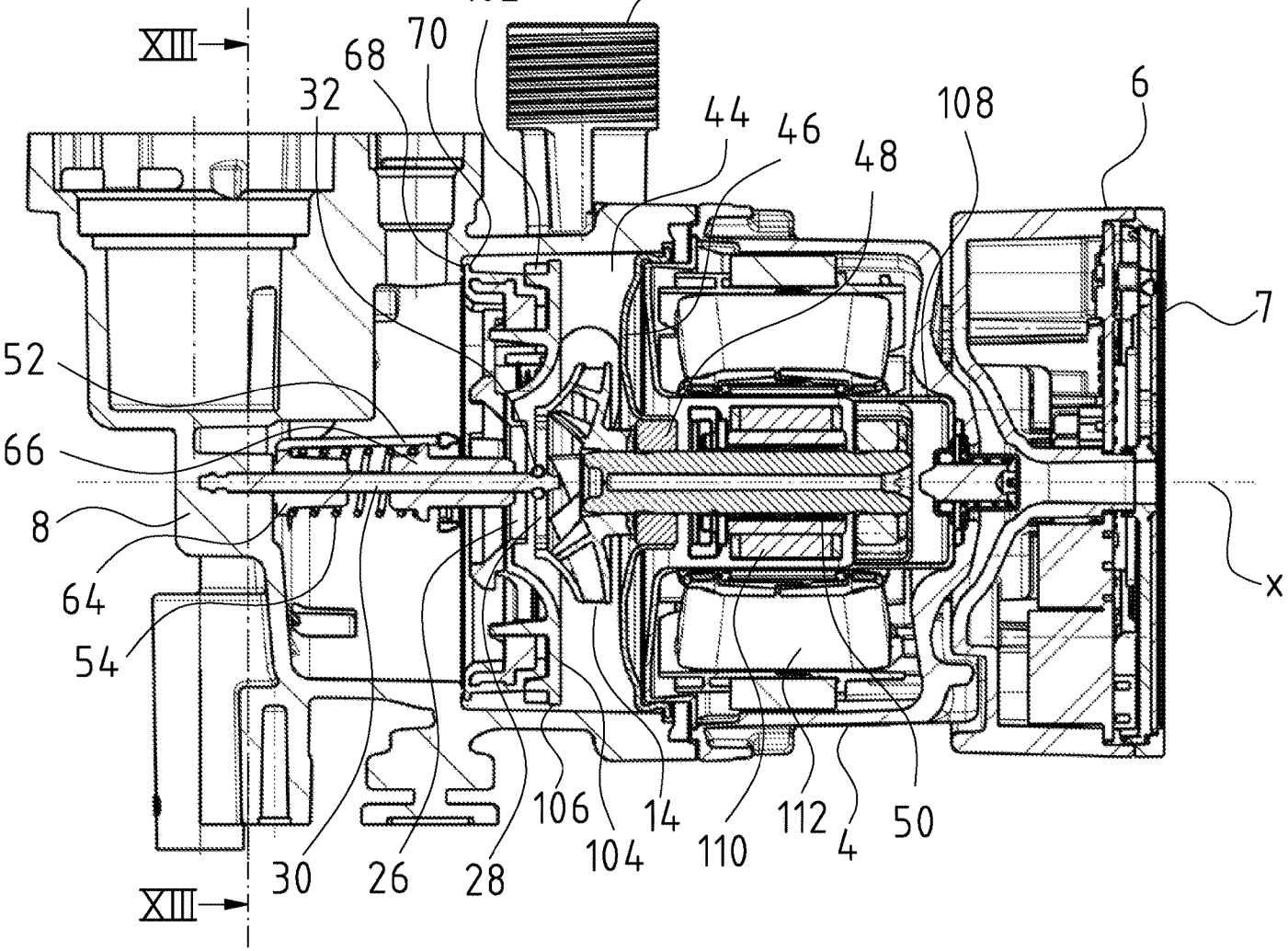
FIG. 3 is a sectional view of the centrifugal pump device according to FIGS. 1 and 2 along line in FIG. 2, with a valve device in its sealed position.
Figure 4:
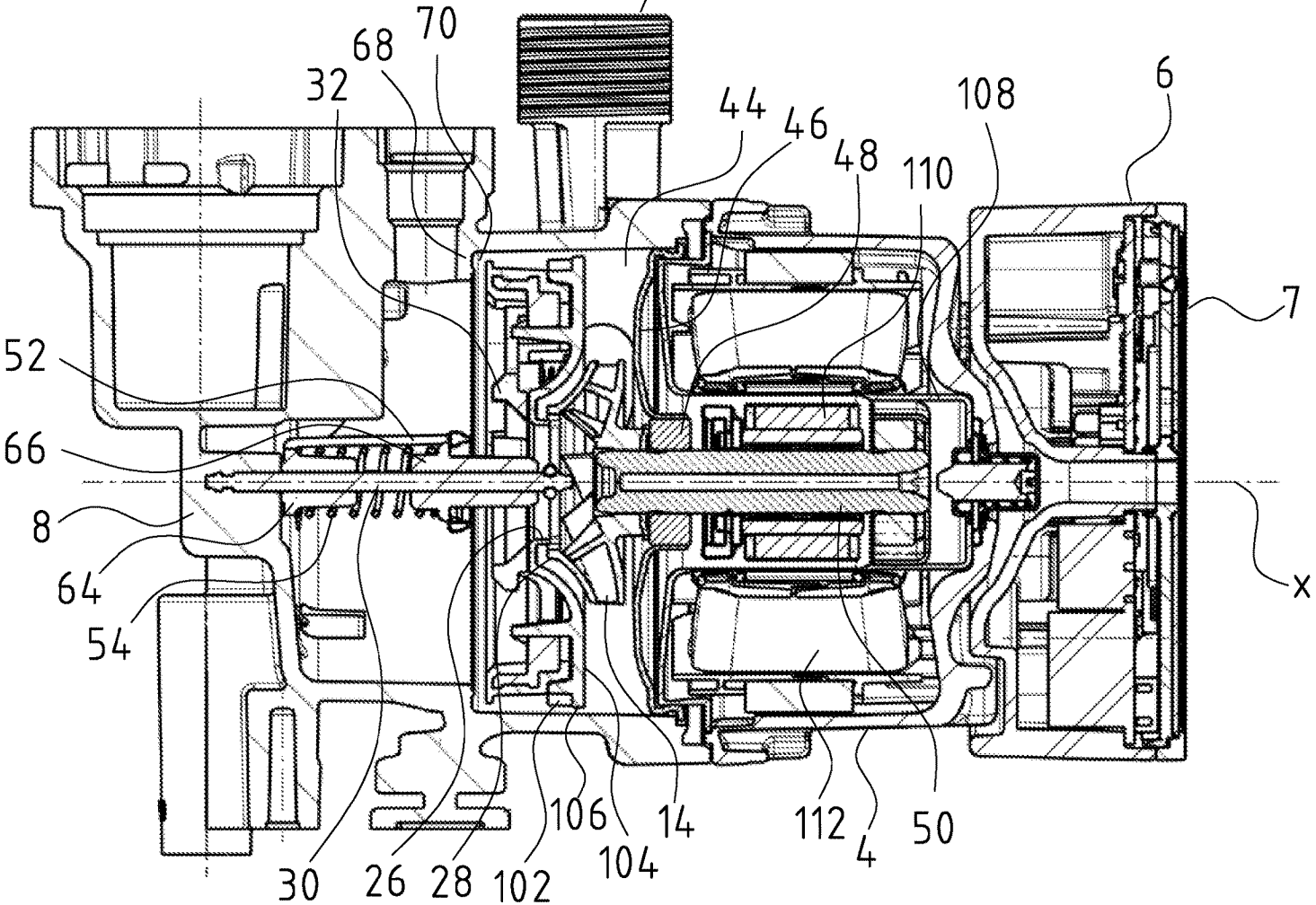
FIG. 4 is a sectional view similar to FIG. 3 with the valve device in its released and rotatable position.
Figure 5:
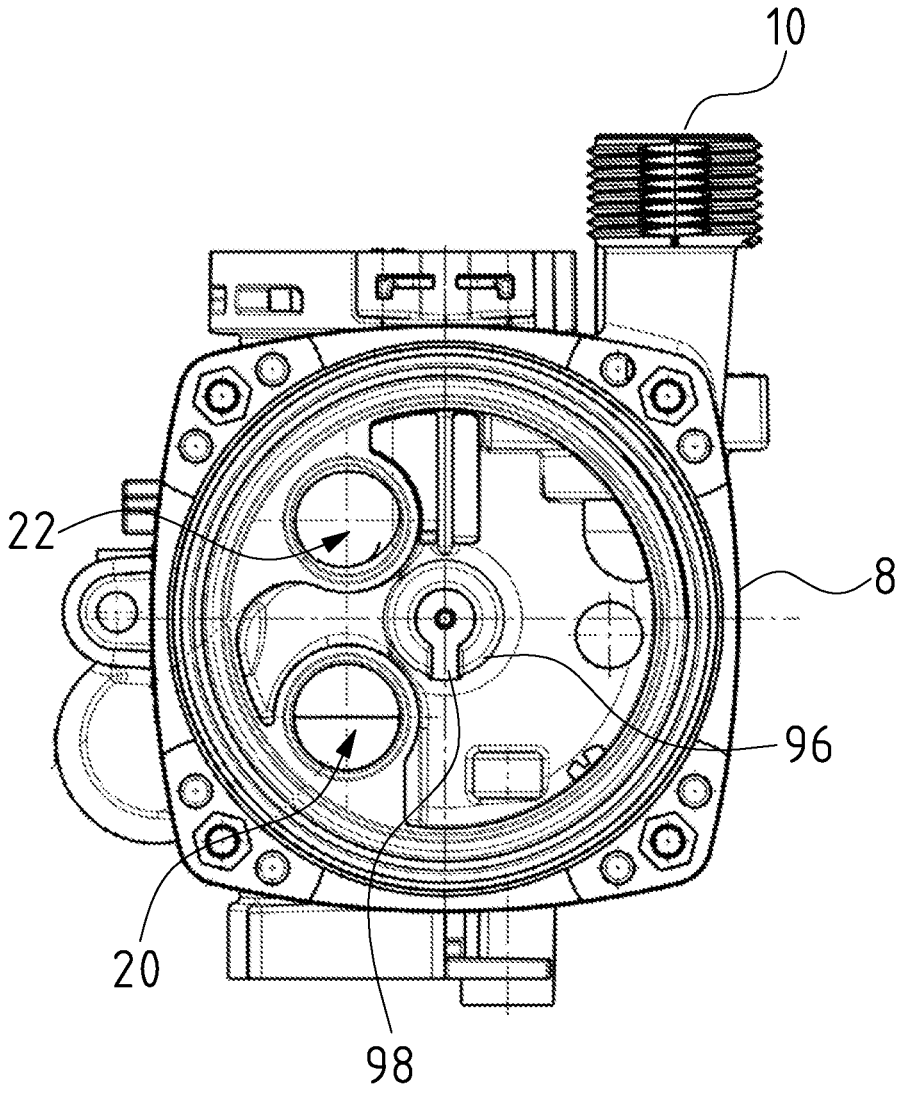
FIG. 5 is a top view on the opened pump housing of the centrifugal pump device according to FIGS. 1 to 4.

The compression spring 54 forces the bearing portions 64 and 66 away from each other and forces the valve element 24 in an axial direction towards the motor housing 4. Under compression of the spring 54 the valve element 24 may be moved towards the bottom side of the pump housing 8, i.e. away from the impeller 14 and the motor housing 4. These two possible axial positions of the valve element 24 are shown in FIGS. 3 and 4. In FIG. 4 the valve element 24 is in its first axial position in which the valve element 24 abuts against a circular shoulder 68 in the interior of the pump housing 8. The shoulder 68 extends in radial direction from the inner circumference of the pump housing 8 providing a circular sealing surface extending substantially perpendicular to the longitudinal axis X. The valve element 24 is in sealing contact with this shoulder 68 via an elastic sealing 70 on the outer circumference of the support member This sealing 70 ensures a sealing of the pump space 44 towards the suction side of the pump device. FIG. 4 shows a second axial position of the valve element 24 in which the valve element 24 is moved towards the impeller 14 such that the sealing 70 is not in contact with the shoulder 68 anymore, but distanced from the shoulder 68. In this position the valve element 24 is freely rotatable about the longitudinal axis X. If the sealing 70, however, is in contact with the shoulder 68 a rotation of the valve element 24 is prohibited due to the frictional forces between the sealing 70 and the shoulder 68. Thus, the shoulder 68 and the sealing 70 act as a detachable coupling or clutch. The valve element 24 is moved into the released position shown in FIG. 4 by the spring forces of the compression spring 54. Into the fixed position as shown in FIG. 3, in which the sealing 70 is in contact with the shoulder 68, the valve element 24 is moved by the pressure produced by the impeller 14 and acting on the cover member 38 surrounding the outlet opening 26. Thus, the valve element 24 can selectively be moved in axial direction depending on the pressure produced by the pump on the outlet side of the impeller 14. This can be controlled by speed control and regulation carried out by the control electronics 7 arranged in the electronics housing 6.

The valve element 24 comprises two sealing portions 72 and 74, i.e. a first sealing portion 72 and a second sealing portion 74. The two sealing portions 72 and 74 are arranged on the outer axial surface of the support member 36, i.e. on the axial face side of the valve element 24 facing away from the impeller and being opposed to the first and second inlet ports 20 and 22. The two sealing portions 72 and 74 are arranged in a common plane extending perpendicular to the rotational axis X. The two sealing portions 72 and 74 are positioned diametral in relation to the axis X, i.e. in positions offset by 180° about the rotational axis X. The two sealing portions 72 and 74 each comprises an elastic sealing member 76, 78, which in this embodiment are formed integral with the sealing 70 on the outer circumference of the support member. The sealing 70 and the sealing members 76 and 78 may be formed as a separate part or sealing arrangement connected to the support member 36 or connected to the support member 36 by an injection molding process.

The first sealing portion 72 is provided to selectively close the first inlet port 20 and the second sealing portion 24 is provided to selectively close the second inlet port 22. Between the two sealing portions 72 and 74 there is provided an opening 80 in the support member 36 being in fluid connection with the outlet opening 26 and forming an entrance opening of the valve element 24.

Figure 6:
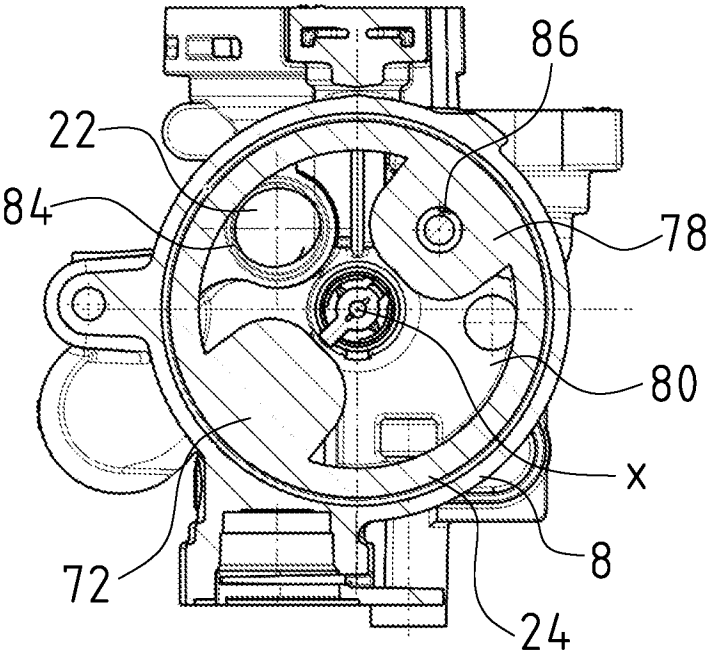
FIG. 6 is a sectional view of the valve device in the centrifugal pump device according to FIGS. 1 to 5, with the valve element in a first valve position.
Figure 8:
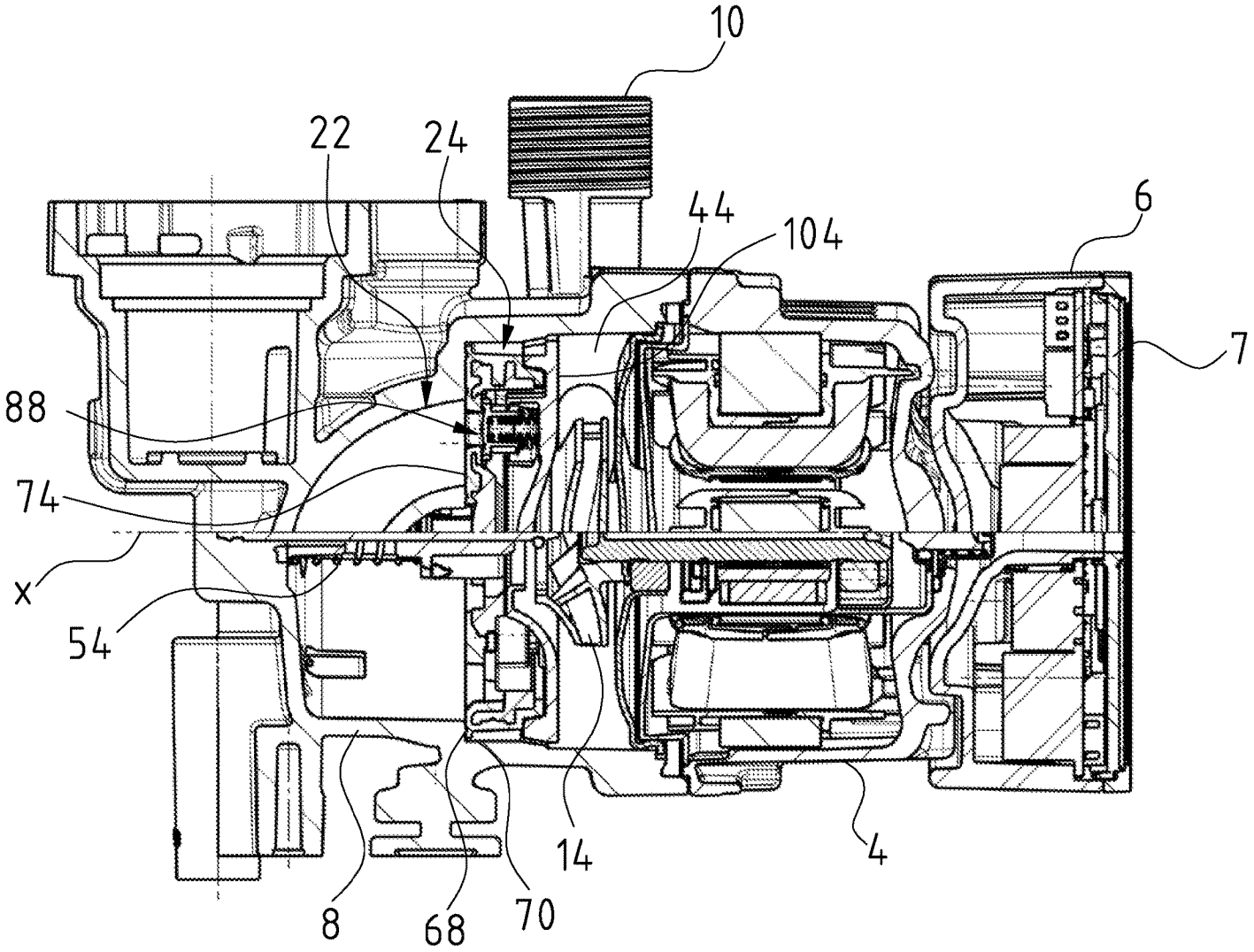
FIG. 8 is a sectional view of the centrifugal pump device along line VIII-VIII in FIG. 2, with the valve element in its second valve position.
Figure 9:
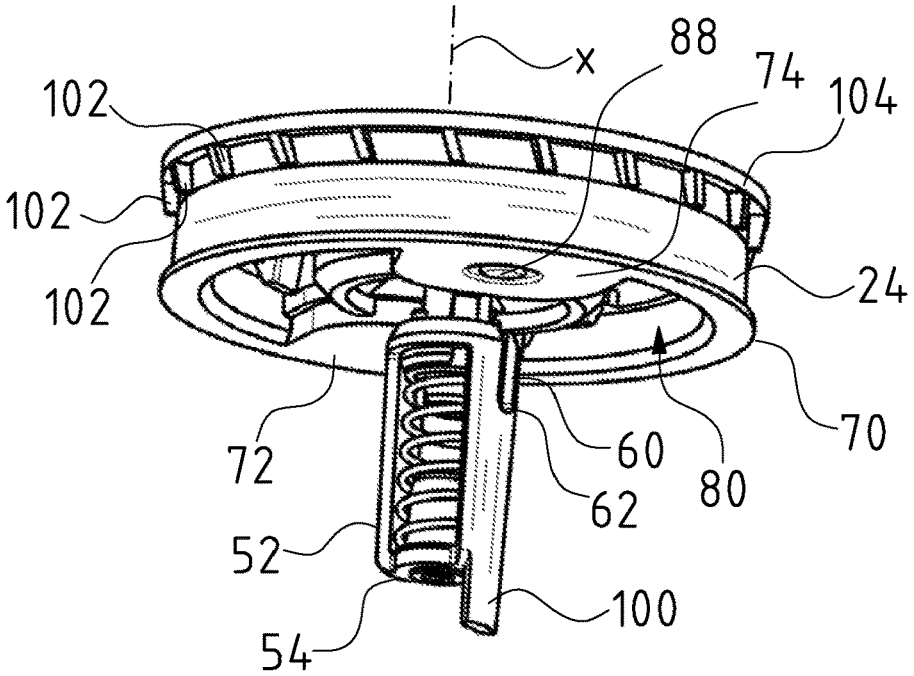
FIG. 9 is a perspective view of the valve element in the centrifugal pump device according to FIGS. 1 to 8.
Figure 10:
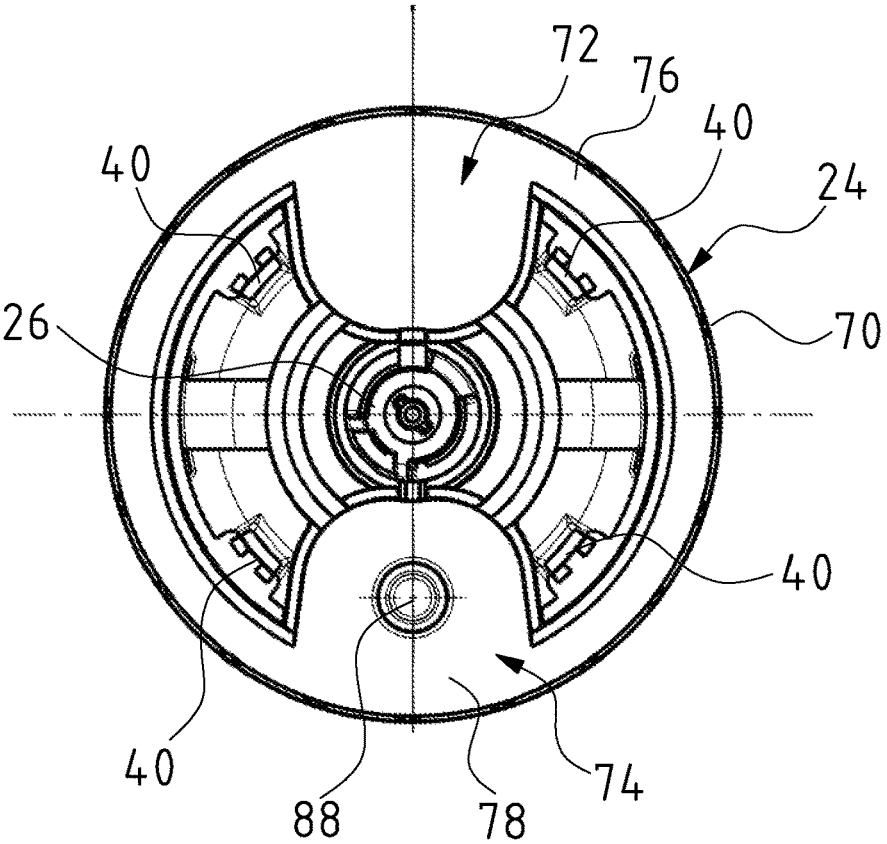
FIG. 10 is a plan view of the bottom side of the valve element containing the sealing portions.
Figure 11:
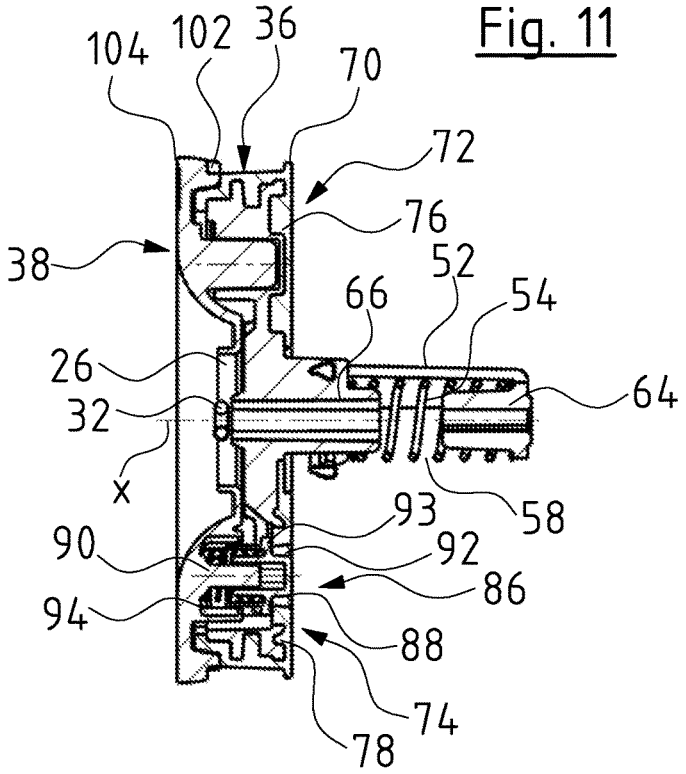
FIG. 11 is a sectional view of the valve element with a bypass valve in its closed position.
Figure 12:
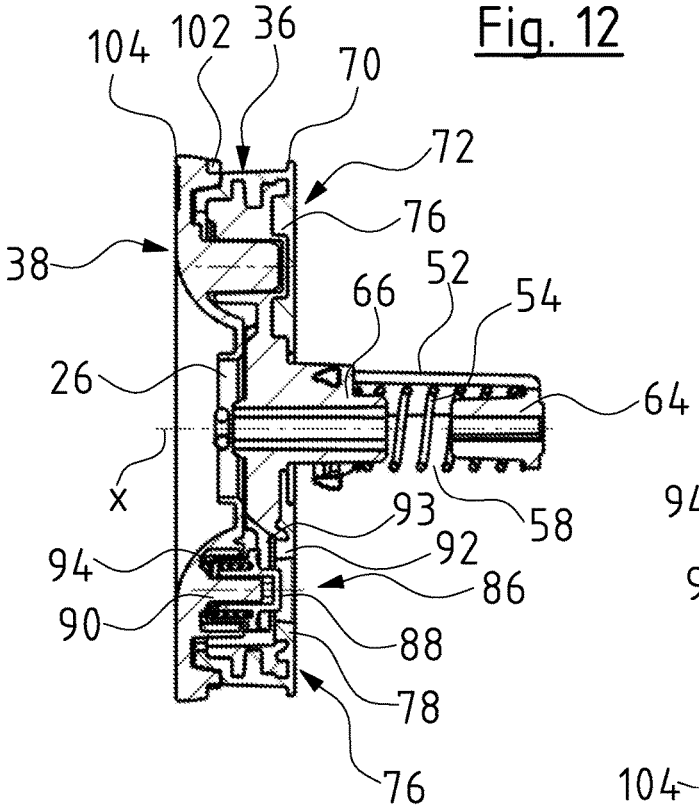
FIG. 12 is a sectional view according to FIG. 11 with the bypass valve in its opened position.

The valve element 24 can take two different valve positions in rotational direction about the longitudinal axis X. FIG. 6 shows the first valve position in which the first sealing portion 72 closes the first inlet port. In this first valve position the second inlet port 22 is open towards the opening 80 in the valve element 24 such that a fluid flow from the inlet port 22 towards the outlet opening 26 and into the suction mouth 28 of the impeller 24 is enabled. In this first valve position, therefore, the impeller 14 and thus the entire pump sucks fluid through the first inlet connection 60 which is connected to the first inlet port 20. In this first valve position when the valve element 24 is in its engaged or sealing position as shown in FIG. 3 the first sealing portion 72 with its sealing member 76 is pressed against a valve seat 82 formed by the surrounding circumference or edge of the inlet port 20. By this the first inlet port 20 is completely closed.

Figure 7:
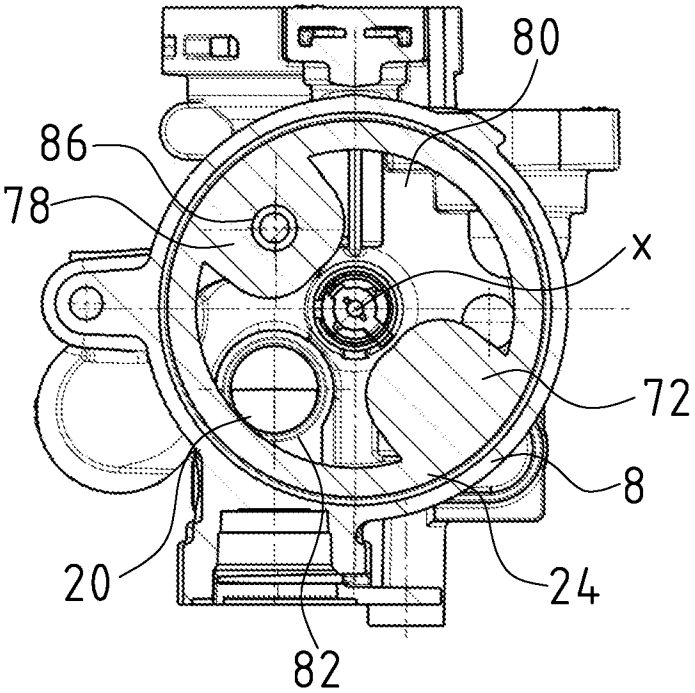
FIG. 7 is a sectional view of the valve device according to FIG. 6 with the valve element in a second valve position.

In the second valve position as shown in FIG. 7 the first sealing portion 72 is rotated aside from the first inlet port 20 such that the first inlet port 20 is opened towards the opening 80 providing a flow path from the first inlet port 20 towards the outlet opening 26 and the suction mouth 28 of the impeller 14. In this second valve position the second sealing portion 24 is moved into a position in which it covers the second inlet port 22 so that the second inlet port 22 is closed. In the engaged or sealed position of the valve element 24 the sealing member 78 of the second sealing portion 24 is pressed against a valve seat 84 formed on the outer circumference or edge of the second inlet opening 22.

Deferring from the first sealing portion 76 the second sealing portion 78 is not completely closed but contains a further valve in form of a check valve forming a bypass valve 86 as best shown in FIGS. 10-13. The bypass valve 86 has an opening 92 in the second sealing portion 74 which opening 92 is facing the second inlet port 22 in the second valve position as shown in FIG. 7. The bypass valve 86 comprises a bypass valve element 88 arranged between the support member 36 and cover member 38 of the valve element 24. The bypass valve element 88 is guided in a linear direction parallel to the rotational axis X on a guiding element 90 engaging into the bypass element 88. The bypass valve element 88 in its closed position abuts against a valve seat formed by the sealing member 78 surrounding the opening 92 or defining the opening 92 inside the second sealing portion 74. The bypass valve element 88 is held in this closed or sealed position by a compression spring 94 forcing the bypass valve element 88 into the shown sealed or closed position. By a pressure acting on the bypass valve element 88 the bypass valve element 88 can be moved along the guiding element 90 against the force provided by the compression spring 94 to open the opening 92. The backside of the bypass valve element 88 facing away from the opening 92 is in contact with the opening 80 and the outlet opening 26, i.e. in contact with the suction side of the pump and with the flow path towards the suction mouth 28 of the impeller 14. Thus, the pressure on the suction side of the pump is acting onto the backside of the bypass valve element 88. If the pressure difference between both sides of the bypass valve 86 or bypass valve element 88, respectively, exceeds a predefined threshold, which is defined by the size of the bypass valve element 88 and the spring 94, the bypass valve 86 opens to allow a fluid flow from the second inlet port 22 towards the impeller 14 although the second inlet port 22 is closed by the second sealing portion 74. This functionality may be used in a heating system when a heating circuit in a building is connected to the first inlet connection 16. In case that all radiators in the heating circuit are closed there would be no fluid flow through this first inlet connection 16. In this condition the pressure on the suction side of the impeller 14 and, therefore, on the backside of the bypass valve element 88 will reduce to such an extent that the pressure difference across the bypass valve 86 exceeds the predefined threshold and the bypass valve 86 opens ensuring a fluid flow through the second inlet port 22 to which for example a heating exchanger for heating domestic water may be connected. In a heating system, thus, a fluid flow through the boiler can be ensured avoiding an overheating of the boiler.

The threshold for opening the bypass by the bypass valve 86 preferably is adjusted by exchanging the bypass valve element 88. There may be provided exchangeable bypass valve elements 88 of different size, in particular having different sized back surfaces onto which the pressure on the suction side of the pump acts. Since the opposite surface is always defined by the cross section of the opening 92 it is possible to adjust the forces acting in both directions onto the bypass valve element 88 by changing the size of the back surface. Alternatively, or in addition also the size of the surface closing the opening 92 can be adjusted by changing the diameter of the circular protrusion 93 on the bypass valve element 88 being in contact with the valve seat in the sealing member 78.

Figure 13:
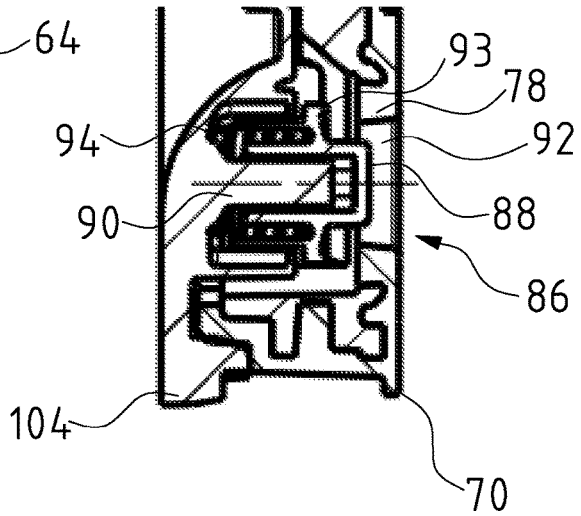
FIG. 13 is an enlarged cross section of the bypass valve 86 as shown in FIG. 12.
Figure 14:
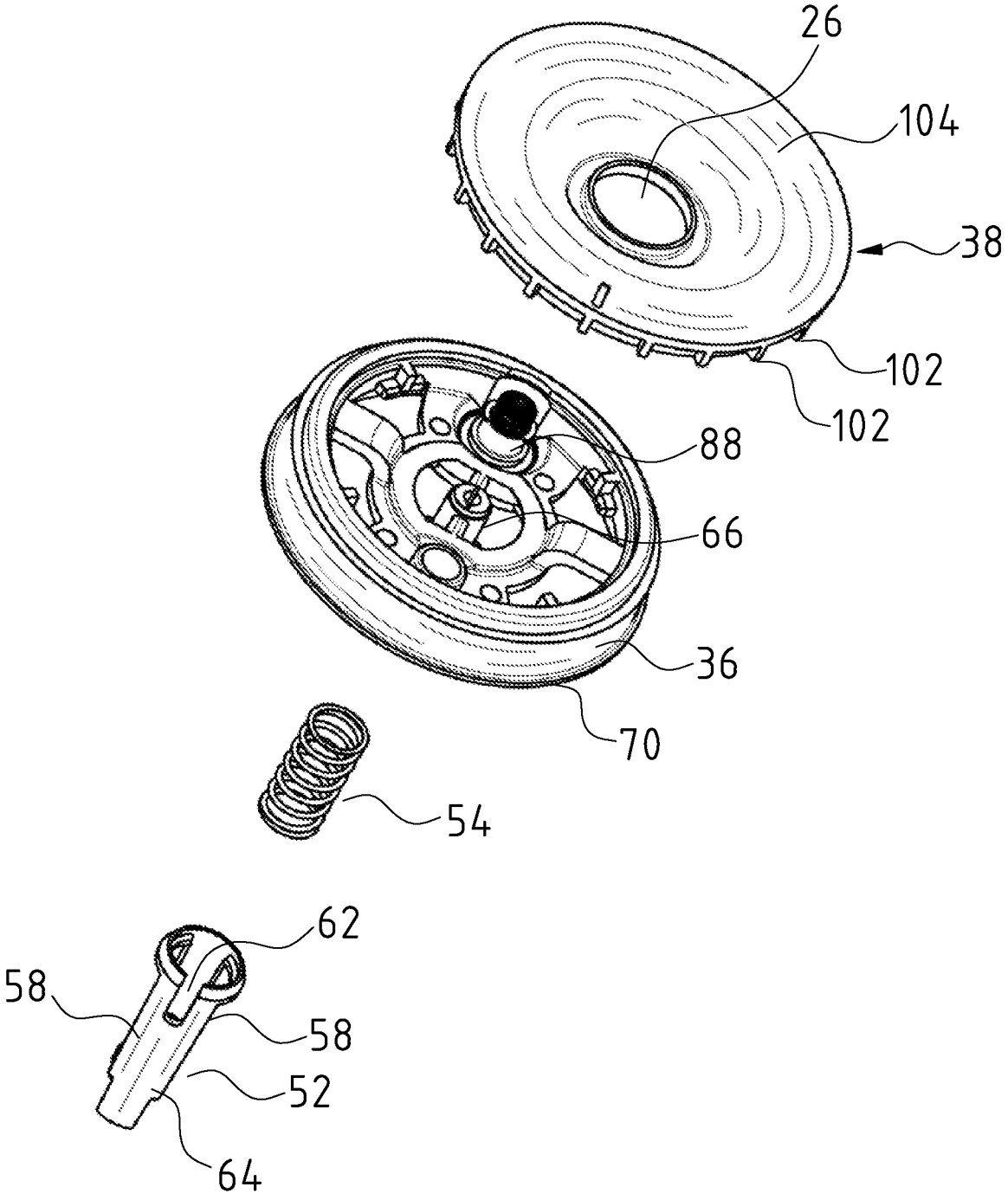
FIG. 14 is an exploded view of the valve element according to FIG. 9.
Figure 15:
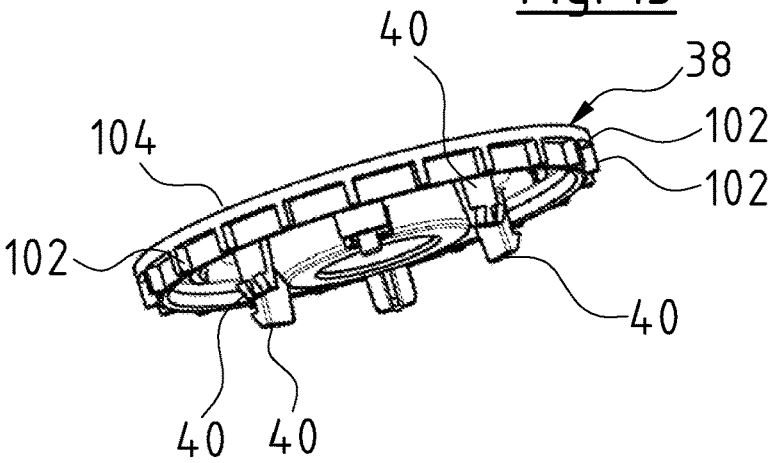
FIG. 15 is an exploded view of the valve element according to seen from a different direction.
Figure 15:
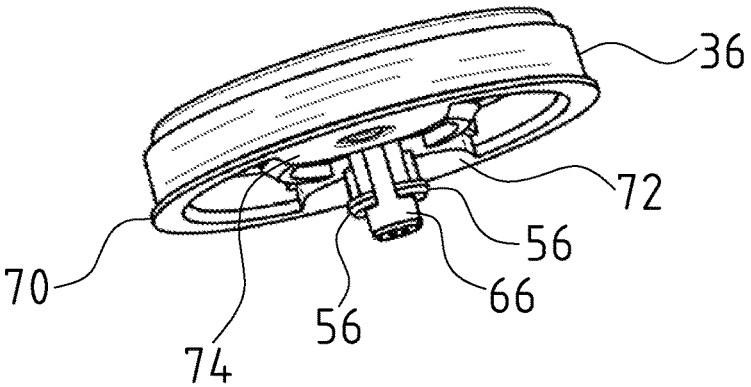
Figure 15:
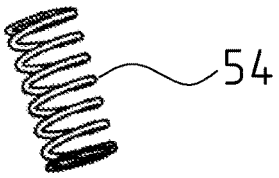
Figure 15:
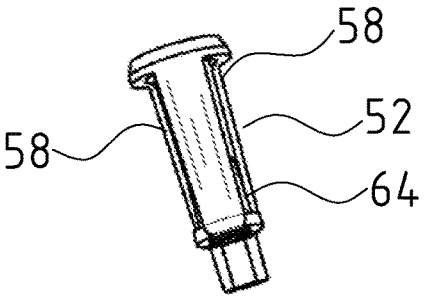
Figure 17:
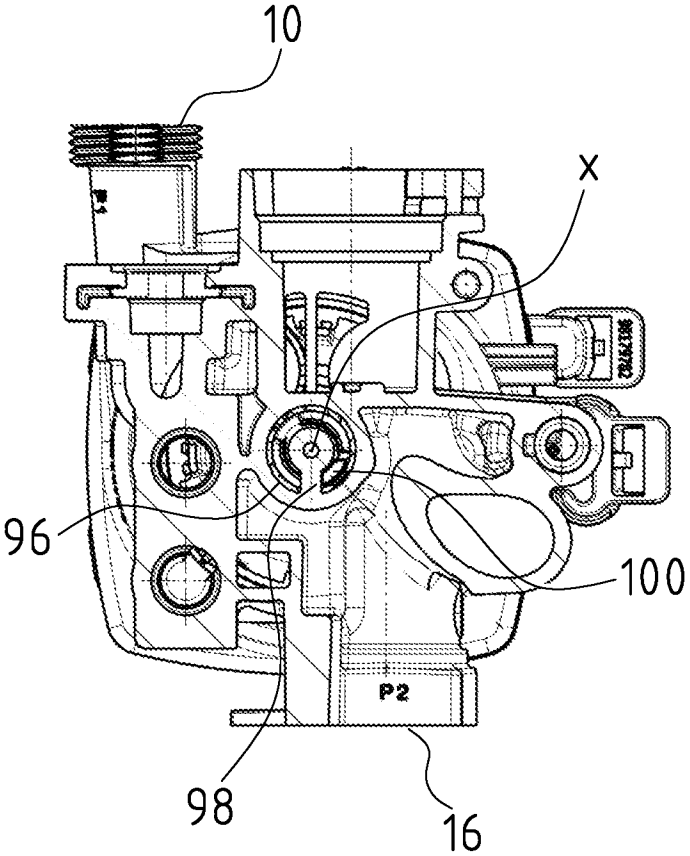
FIG. 17 is a sectional view according to FIG. 18 with the valve element in the first valve position.
Figure 16:
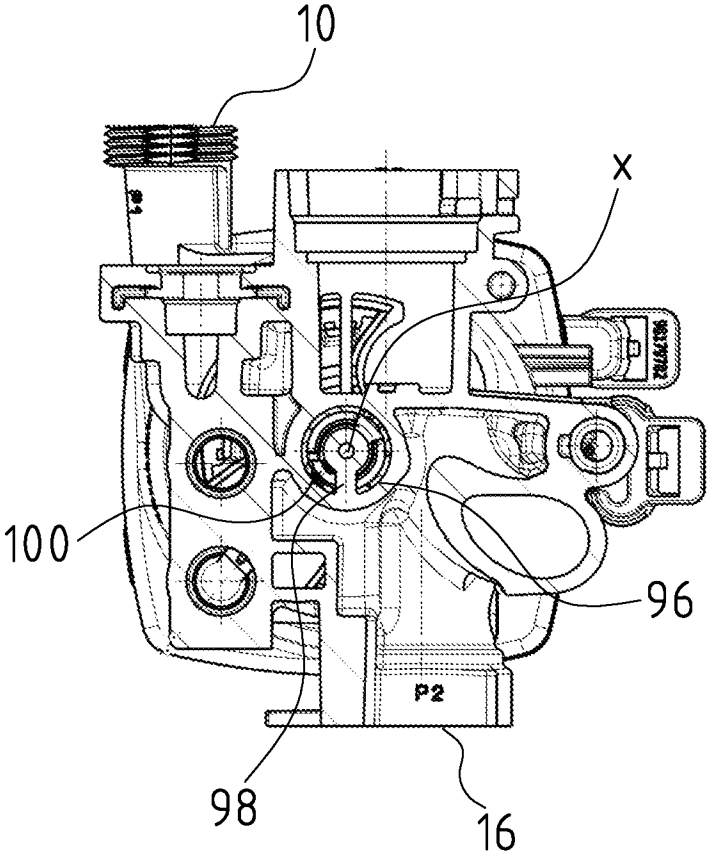
FIG. 16 is a sectional view of the pump housing along line XIII-XIII in FIG. 3 with the valve element in the second valve position.

The valve element 24 is moved between the two valve positions similar as known from EP 3 376 049 by the circulating flow produced by the impeller 14. If the speed of the electric drive motor is reduced or the motor is switched off by the control electronics 7 the pressure in the pump space 44 is reduced such that the compression spring 44 moves the valve element 24 in its released position as shown in FIG. 4. In this position the valve element 24 can be rotated about the rotational axis X by a circulating fluid flow inside the pump space 44. The direction of the fluid flow depends on the rotational direction of the impeller 14. The two valve positions are each defined by an end stop. For this there is provided a circular groove 96 in the bottom wall of the pump housing 8. This circular groove 96 does not define an entire circle but has an interruption in form of a web 98. The opposing surfaces of this web 98 define the two end stops for the rotational movement of the valve element 24, i.e. the end stops defining the two possible valve positions. The spring support 52 of the valve element 24 has an axial extension forming a stop element 100. The stop element 100 has a form of a finger offset to the rotational axis X and engaging into the groove 96. The stop element 100 can abut against the two opposing faces of the web 98 to define the two rotational positions corresponding to the possible valve position as described before. In this case it is advantageous that the stop is arranged in the center allowing a damping effect due to the elasticity of the parts and particularly by torsion of the compression spring 54 as described above. FIG. 13 shows the stop element 100 in the second valve position corresponding to the position shown in FIG. 7. FIG. 14 shows the stop element 100 in the first valve position corresponding to the valve position shown in FIG. 6. It can be seen that to change the valve position the valve element 24 rotates by 270°.

To enhance the rotation of the valve element 24 without increasing the flow resistance during normal operation of the pump device there are provided radial protrusions 102 distributed over the entire outer circumference of the valve element 24. The protrusions 102 are arranged on the backside of the cover plate 104 on the cover member 38 so that the cover member 36 has a cover plate 104 facing towards the impeller 14 extending in radial direction beyond these protrusions 102 so that the protrusions 102 are completely covered by this cover plate 104 on the side facing the impeller 14. Thus, the protrusions 102 are arranged on the backside of the cover plate 104. The cover plate 104 has a diameter smaller than the inner diameter of the pump housing 8 such that a circular gap 106 surrounding the outer circumference of the cover plate 104 is provided. The gap 106 provides a flow connection between the pump space 44 and the region in which the protrusions 102 are arranged. If the valve element 24 is in its sealed or engaged position as shown in FIG. 3, substantially no fluid flow through the gap 106 will occur since the flow path through the gap 106 is closed by the sealing 70 on the opposite end. However, if the valve element 24 is in its released position as shown in FIG. 4 there is a gap between the sealing 70 and the shoulder 68 opening the flow path through the gap 106 towards the opening 80 of the valve element 24, i.e. on the suction side of the valve element 24. Thus, if the impeller 14 rotates, a part of the fluid flow leaving the impeller 14 will enter the gap 106 and flow towards the opening 80 around the valve element 24 towards the outlet opening 26. Due to the rotation of the impeller 14 this side flow through the gap 106 has a spin in the rotational direction of the impeller acting on the rib or tooth shaped protrusions 102 generating a torque on the valve element 24 to rotate the valve element 24 until the stop element 100 abuts against the end stop provided by the web 98. If, now, the speed of the impeller is increased by the control electronics 7 the pressure on the outside of the impeller 14 increases so that the valve element 24 is moved into its sealed position in which the sealing 70 comes into contact with the shoulder 68 and one of the sealing portions 72, 74 comes into contact with an opposing valve seat 82, 84. In this operational condition a sealed valve position is reached. After this it is possible to quickly change the rotational direction of the impeller without moving the valve element 24 out of its present valve position. To achieve this, due to respective control by the control electronics 7 the electric drive motor is accelerated thus quickly that the pressure outside the impeller 24 generates an axial force overcoming the spring force of the compression spring 54 prior to establishing a circular flow rotating the valve element 24 into the other valve position. This allows to selectively move the valve element 24 into a desired valve position and afterwards to again change the rotational direction of the impeller 14 so that during operation of the centrifugal pump device the impeller 14 can always rotate in a desired optimized rotational direction. The arrangement of the protrusions 102 on the backside of the cover plate 104 has the advantage that the protrusions have an effect only if the valve element 24 is in its released position. During normal operation with the valve element is in its sealed position the protrusions 102 have nearly no effect, in particular they do not increase the hydraulic resistance in the pump space 44.

The electric motor inside the motor housing 4 is a wet-running electric motor having a rotor can 108 forming the rotor space inside which the rotor shaft 50 with the rotor 110 rotates. This rotor space is filled by the liquid to be pumped, i.e. preferably water. The stator 112 is arranged on the outside of the rotor can 108 in a dry stator space inside the motor housing 4.

Figure 18:
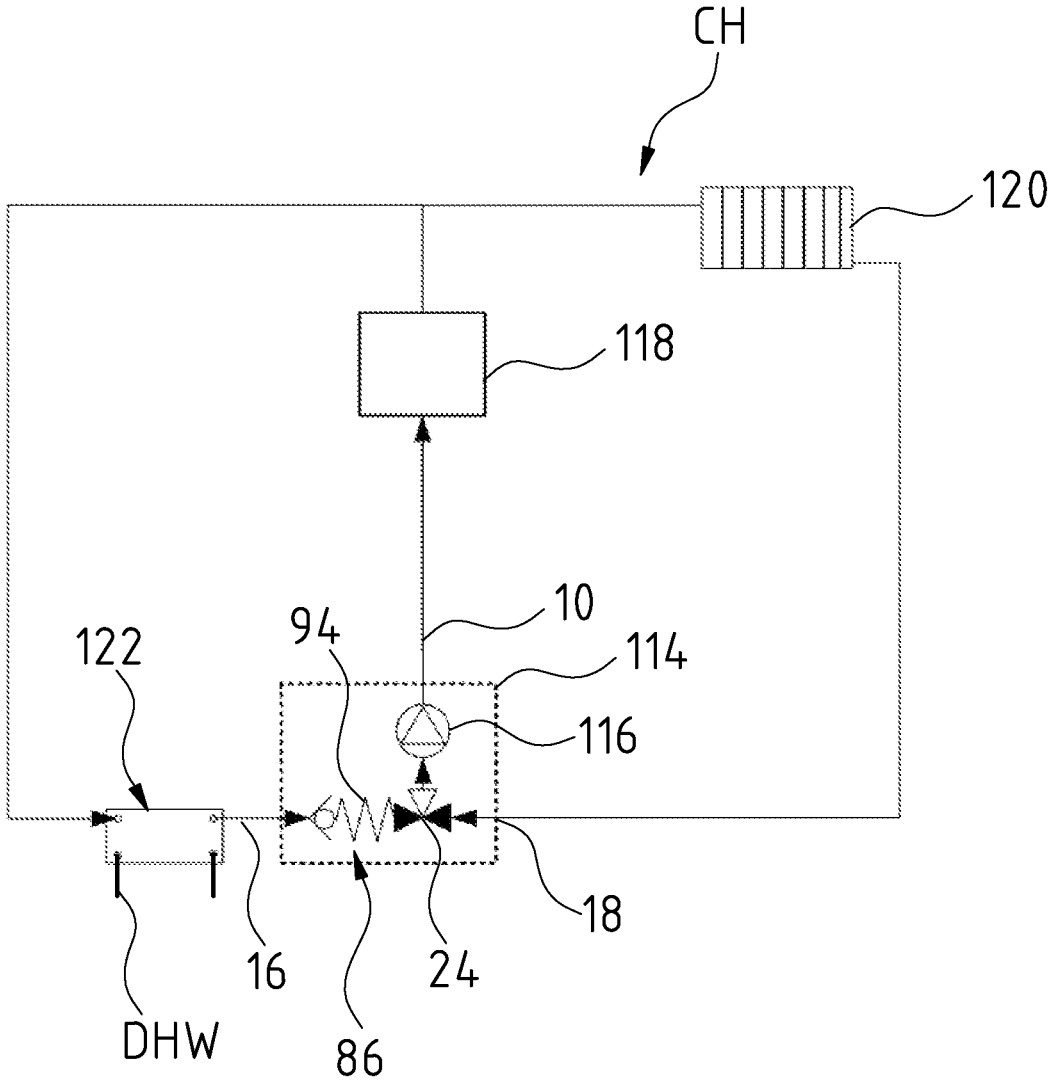
FIG. 18 is a schematical drawing of a hydraulic circuit of a heating system including a centrifugal pump according to the invention.

FIG. 18 shows an example for the use of the centrifugal pump device 114 described before. The centrifugal pump device including the features described before, i.e. the valve element 24 and the bypass valve 86 are the components surrounded by the dotted line in FIG. 18. The centrifugal pump device 114 comprises the centrifugal pump 116 with the electric drive motor 2 and the impeller 14. The valve element 24 forming a switch over valve is arranged on the suction side of the centrifugal pump 116 allowing to switch the flow path between two possible inlet connections, the first inlet connection 16 and the second inlet connection 18.

On the pressure side the centrifugal pump 116 is connected with the outlet connection 10. In this example the outlet connection 10 is connected to a boiler 118 heating the liquid, in particular water, in the heating circuit. On the outlet side of the boiler 118 the heating circuit branches into a first branch forming the circuit of a central heating CH which may contain several radiators 120 or one or more floor heating circuits, for example, and the second branch for heating domestic hot water DHW. The second branch comprises a heat exchanger 122 for heating domestic hot water (DHW). As can been seen, the bypass valve is in connection with the second branch, i.e. the branch containing the heat exchanger 122. In case that the valve element 24 is in the valve position in which a flow path through the central heating circuit CH is open, the bypass valve 86 can prevent an overheating of the boiler 118. In this valve position, if the radiators 120 are closed, the fluid flow through the central heating circuit CH is interrupted. In this case the bypass valve 86 can open due to a pressure difference overcoming the biasing force of the compression spring 94 such that the flow path through the heat exchanger 122 opens and the water is circulated by the centrifugal pump 116 through the second branch of the heating system, i.e. through the heat exchanger 122, thereby distributing the heat produced by the boiler 180 in the system to avoid an overheating of the boiler 118.

Figure 19:
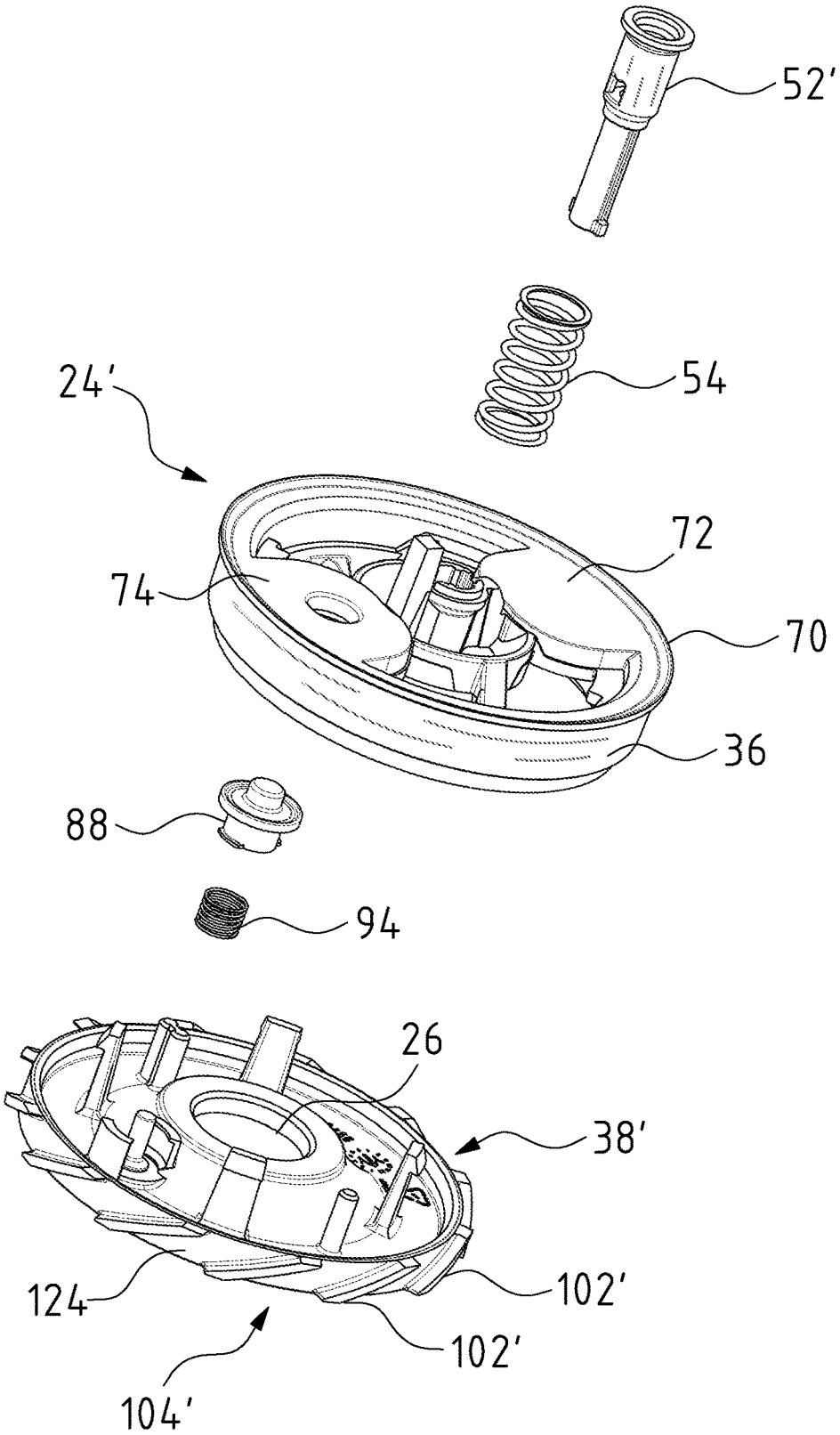
FIG. 19 is an exploded view of a valve element according to a second embodiment.
Figure 20:
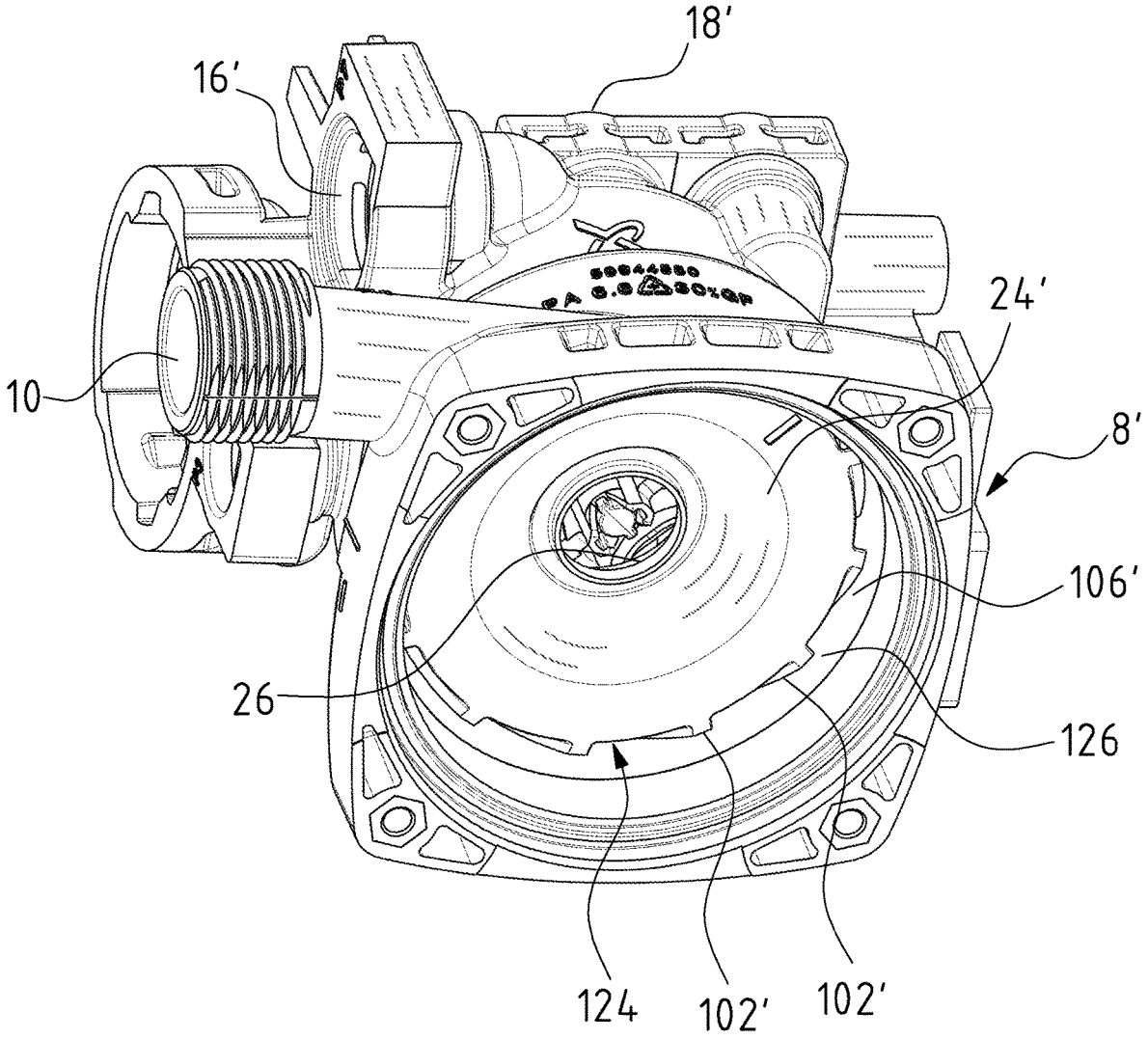
FIG. 20 is a perspective view of an open pump housing including the valve element as shown in FIG. 19.

FIG. 19 shows a second embodiment of the valve element 24'. In this embodiment the support member 36 including the bypass valve 86 is substantially the same as described above. In this second embodiment the cover member 38' of the valve element 24' has a different design. In this embodiment the protrusions 102' extend in radial direction from an outer circumferential surface 124. Furthermore, the protrusions 102' are inclined in circumferential direction such that they form inclined vanes on the outer circumferential surface 124 of the valve element. In this embodiment the cover plate 104' does not extend beyond the outer circumference of the circumferential wall 124, i.e. does not cover the axial end sides of the protrusions 102'. Thus, by use of this valve element 24' the gap 106' or ring-shaped space between the outer circumferential wall 124 of the valve element and an inner 5 circumferential wall 126 of the pump housing 8' is open towards the space containing the impeller 14, as visible in FIG. 20. Thus, a fluid flow produced by the impeller 14 can directly impinge on the protrusions 102'. Due to their inclination the protrusions 102' produce a higher torque acting on the valve element 24' about the rotational axis X. The pump housing 8' with the valve element 24' as shown in FIG. 20 can be connected to the electric drive motor 2 as shown in FIG. 1 and described above. Furthermore, the impeller 14 can be the same as shown for the first embodiment.

LIST OF REFERENCE NUMBERS

2 electric drive motor
4 motor housing
6 electronics housing
7 control electronics
8, 8' pump housing
10 outlet connection
12 outlet port
14 impeller
16, 16' first inlet connection
18, 18' second inlet connection
20 first inlet port
22 second inlet port
24, 24' valve element
26 outlet opening
28 suction mouth
30 pivot, bearing post
32 O-ring
34 notch
36 support member
38, 38' cover member
40 engagement hook
42 engagement shoulder
44 pump space
46 bearing plate
48 bearing
50 rotor shaft
52, 52' spring support
54 compression spring
30 56 engagement hooks
58 cut-out
60 rib
62 slots
64 bearing portion
66 bearing portion
68 shoulder
70 sealing
72 first sealing portion
74 second sealing portion
76, 78 sealing member
80 opening
82, 84 valve seats
86 bypass valve
88 bypass valve element
90 guiding element
92 opening
93 protrusion
94 compression spring
96 groove
98 web
100 stop element
102, 102' protrusions
104, 104' cover plate
106, 106' gap
108 rotor can
110 rotor
112 stator
114 centrifugal pump device
116 centrifugal pump
118 boiler
120 radiator
122 heat exchanger
124 outer circumferential wall
126 inner circumferential wall
CH central heating
DHW domestic hot water
X rotational axis

The invention claimed is:

1. A centrifugal pump assembly, the assembly comprising:

an electric drive motor;

at least one impeller driven by said electric drive motor; and a valve element rotatable between two valve positions driven by a fluid flow produced by said impeller, wherein the valve element comprises a cover plate extending transverse to the rotational axis of the impeller and facing the impeller, wherein the valve element comprises protrusions extending radially from an outer circumference of the valve element and the protrusions being arranged on an outer surface side facing away from the impeller such that a flow can act on the protrusions for driving the valve element to rotate the valve element about a rotational axis of the valve element.

2. The centrifugal pump assembly according to claim 1, wherein the protrusions are inclined in the circumferential direction.

3. The centrifugal pump assembly according to claim 1, wherein the protrusions are extending in a radial direction related to the rotational axis of the valve element and in the radial direction the cover plate extends beyond the protrusions.

4. The centrifugal pump assembly according to claim 1, wherein the rotational axis of the valve element extends parallel and along the rotational axis of the impeller.

5. The centrifugal pump assembly according to claim 1, wherein the valve element is arranged inside a housing having a circular inner wall surrounding an outer circumference of the valve element with a ring-shaped gap between the outer circumference of the cover plate and the inner wall.

6. The centrifugal pump assembly according to claim 1, wherein the protrusions are evenly distributed over an outer circumference of the vale element.

7. The centrifugal pump assembly according to claim 1, wherein the protrusions are of toothlike shape and are extending normal to a cylindrical outer circumferential wall of the valve element.

8. The centrifugal pump assembly according to claim 1, wherein the protrusions are integrally formed with an outer circumferential wall and/or the cover plate of the valve element.

9. The centrifugal pump assembly according to claim 1, wherein the cover plate of the valve element comprises a central outlet opening being in engagement with a suction mouth of the impeller.

10. The centrifugal pump assembly according to claim 1, wherein said valve element is supported on a central bearing post and fixed in axial direction on this bearing post by an O-ring, wherein the O-ring engages into a notch on the outer circumference of the bearing post.

11. The centrifugal pump assembly according to claim 10, wherein the bearing post is attached to an internal surface of a pump housing and integrally formed with at least this internal surface of the pump housing.

12. The centrifugal pump assembly according to claim 1, wherein the valve element comprises at least one sealing portion for selectively closing a first and a second inlet port such that in a first valve position the first inlet port is closed and in a second valve position the second inlet port is closed.

13. The centrifugal pump assembly according to claim 1, wherein the valve element is movable in linear direction along its rotational axis and the valve element is movable in linear direction such that in a first axial position the at least one sealing portion is in sealing contact with an opposed valve seat and in a second axial position the sealing portion is distanced from an opposed valve seat.

14. The centrifugal pump assembly according to claim 13, wherein the valve element comprises a sealing member surrounding the inlet opening and arranged such that in a first axial position of the valve element the sealing member is in contact with an opposing sealing surface and in a second axial position of the valve element the sealing member is distanced from this sealing surface, wherein said sealing member surrounding the inlet opening of the valve element is arranged on the outer circumference of the valve element.

15. The centrifugal pump assembly according to claim 14, wherein said sealing member surrounding the inlet opening is arranged on an axial end of the valve element opposite to the axial end formed by the cover plate.

16. The centrifugal pump assembly according to claim 1, wherein the valve element comprises at least one inlet opening being in flow connection with an outlet opening of the valve element and arranged such that in a first valve position the inlet opening is facing a second inlet port and in a second valve position is facing a first inlet port.

17. A centrifugal pump assembly, the assembly comprising:

an electric drive motor;

at least one impeller driven by said electric drive motor; and a valve element rotatable between two valve positions driven by a fluid flow produced by said impeller, wherein the valve element comprises a cover plate extending transverse to the rotational axis of the impeller and facing the impeller, wherein the valve element comprises a valve element side facing in a direction away from the impeller, the valve element side comprising a circumferential outer surface, the valve element further comprising a plurality of protrusions extending radially outward from the circumferential outer surface, wherein the plurality of protrusions are configured to contact a flow of fluid such that the valve element rotates about a rotational axis of the valve element.

18. The centrifugal pump assembly according to claim 17, further comprising an electronics housing, wherein the valve element side faces in a direction away from the electronics housing.

19. The centrifugal pump assembly according to claim 17, further comprising a pump housing, wherein the valve element side faces in a direction of the pump housing.

20. The centrifugal pump assembly according to claim 17, wherein the protrusions are extending in a radial direction related to the rotational axis of the valve element and in the radial direction the cover plate extends beyond the protrusions.

* * * * *